US006533598B1

(12) United States Patent
Bentley et al.

(10) Patent No.: US 6,533,598 B1
(45) **Date of Patent: *Mar. 18, 2003**

(54) LOCKABLE WALL OUTLET ELECTRICAL RECEPTACLE

(76) Inventors: James K Bentley, P.O. Box 2848, Paso Robles, CA (US) 93447; Richard G Davidson, 1690 El Camino Real, Atascadero, CA (US) 93442

( * ) Notice: Subject to any disclaimer, the term of this patent is extended or adjusted under 35 U.S.C. 154(b) by 0 days.

This patent is subject to a terminal disclaimer.

(21) Appl. No.: 10/054,496

(22) Filed: Nov. 12, 2001

(51) Int. Cl.[7] ..... H01R 13/625
(52) U.S. Cl. ..... 439/346
(58) Field of Search ..... 439/346

(56) References Cited

U.S. PATENT DOCUMENTS 3,891,289 A * 6/1975 Hanke ..... 439/346
6,315,593 B1 * 11/2001 Bentley et al. ..... 439/346

* cited by examiner

*Primary Examiner*—Gary Paumen
(74) *Attorney, Agent, or Firm*—Charles C. Logan, II

(57) ABSTRACT

A lockable wall outlet electrical receptacle having a housing with a pair of vertically spaced electrical plug aperture set formed in its front wall surface. The housing would be made of a plastic material that is electrically nonconductive. There are chambers and channels in the structure of the housing for receiving the left blade prong terminal, the right blade prong terminal and the ground prong terminal for each of the respective sets electrical plug apertures. The rear end of the respective prong terminals are electrically connected to electrical wire connection terminals on the outer surface of the housing. An upper and a lower shaft have their front ends extending outwardly from the left side wall surface of the housing. The shafts have structure formed in their peripheral surface that allows a predetermined number of degrees of rotation to lock the blade prongs of a male electrical plug in the wall outlet receptacle after they have been inserted into the electrical plug apertures. A mechanical structure having a lever arm for actuation connects the respective upper and lower shaft members so that they would be rotated at the same time.

15 Claims, 3 Drawing Sheets

50
48
79
69
102
32
26

50
48
69
110
102
32
26

69
110
48

69
110
48

69
48
110

24
35
48
40
22
69
42
32
67

50
48
32

LOCKABLE WALL OUTLET ELECTRICAL RECEPTACLE

BACKGROUND OF THE INVENTION

The invention relates to a wall outlet electrical receptacle and more specifically to a lockable wall outlet electrical receptacle.

Conventional wall outlet electrical receptacles do not have any structure for locking them to the male electrical plug that is found on the end of an electrical cord of an electrical appliance or electrical tool. When a vacuum cleaner is used either in the home or a workplace; the male electrical plug will generally pull out of the wall outlet electrical receptacle several times during operation. Likewise when someone is using an electrical tool while they are moving about, its male electrical plug will often pull out of the wall outlet electrical receptacle.

The Alemaghides U.S. Pat. No. 2,454,024; the Cohen U.S. Pat. No. 2,792,561; the Horwinski U.S. Pat. No. 3,997,225; and the Lee U.S. Pat. No. 5,211,584 disclose multiple electrical receptacle units adapted to be attached to a wall-mount receptacle. None of these disclose structure for locking the male electrical plug of a tool or appliance to the wall outlet electrical receptacle unit.

The Ballmer U.S. Pat. No. 4,061,409 discloses a releasable locking means for a two-part electrical connector member for preventing the accidental separation of the two body members when they are joined in electrical engagement. The use of the releasable locking means requires that one of the blade prongs on the male electrical plug have a cutaway portion thereby making it non-operational with a conventional male electrical plug.

The Sowers U.S. Pat. No. 5,316,493 discloses an electrical connection between the male connector on an electrical cord and a female electrical connector either on the end of an[1] electrical cord or in an electrical outlet socket. Necessary structure for this device to operate requires that the ground prong have a notch therein and this structure therefore would not work with a conventional male electrical plug.

It is an object of the invention to provide a novel wall outlet electrical receptacle that has a locking mechanism for securing the male electrical plug of an electrical appliance or tool thereto.

It is another object of the invention to provide a novel lockable wall outlet electrical receptacle that is economical to manufacture and market.

It is a further object of the invention to provide a novel lockable wall outlet electrical receptacle that does not require any modification to the blade prongs of a conventional male electrical plug.

It is also an object of the invention to provide a novel lockable wall outlet electrical receptacle that allows a male electrical plug to be quickly and easily locked therein or released therefrom.

It is another object of the invention to provide a novel lockable wall outlet electrical that eliminates the danger of a partial pullout of a male electrical plug in areas frequented by small children.

SUMMARY OF THE INVENTION

The lockable wall outlet electrical receptacle has a housing having a front wall surface, a rear wall surface, a top wall surface, a bottom wall surface, a left side wall surface and a right side wall surface. An upper and a lower pair of laterally spaced electrical plug apertures are formed in the front wall surface of the housing. Each pair of electrical plug apertures has its own ground prong aperture.

Extending inwardly from each of the electrical plug apertures is a channel and in these channels are mounted the respective left blade prong terminal, the right blade prong terminal and the ground prong terminal. The respective rear ends of these members are electrically connected to electrical wire connection terminals on the outside of the housing. A transversely extending horizontally oriented upper shaft member and horizontally oriented lower shaft member are journaled in the housing at a predetermined height above the respective left and right blade prong terminals. Each of the shafts has a transversely extending groove formed in its outer periphery at a position above one of the blade prong terminals. This transversely extending groove aligns with one of the blade prongs of a male electrical plug so that it can be freely inserted or withdrawn from the respective electrical plug apertures when the shaft is in its unlocked position. Rotation of the respective shafts allows an edge on the shafts to press downwardly upon the top edge of one of the male blade prongs and locks it within the housing of the wall outlet electrical receptacle. Instead of a transversely extending groove, a cam surface may be utilized at the same position on the shaft. Additionally the channels into which a male blade prong is inserted may have ridges or teeth extending upwardly therefrom to frictionally contact the bottom edge of the male blade prong and provide more gripping power.

The front ends of the respective shaft members may be attached to different types structures for actuating the locking mechanism that rotates the respective shafts at the same time.

DESCRIPTION OF THE PREFERRED EMBODIMENT

Figure 1:
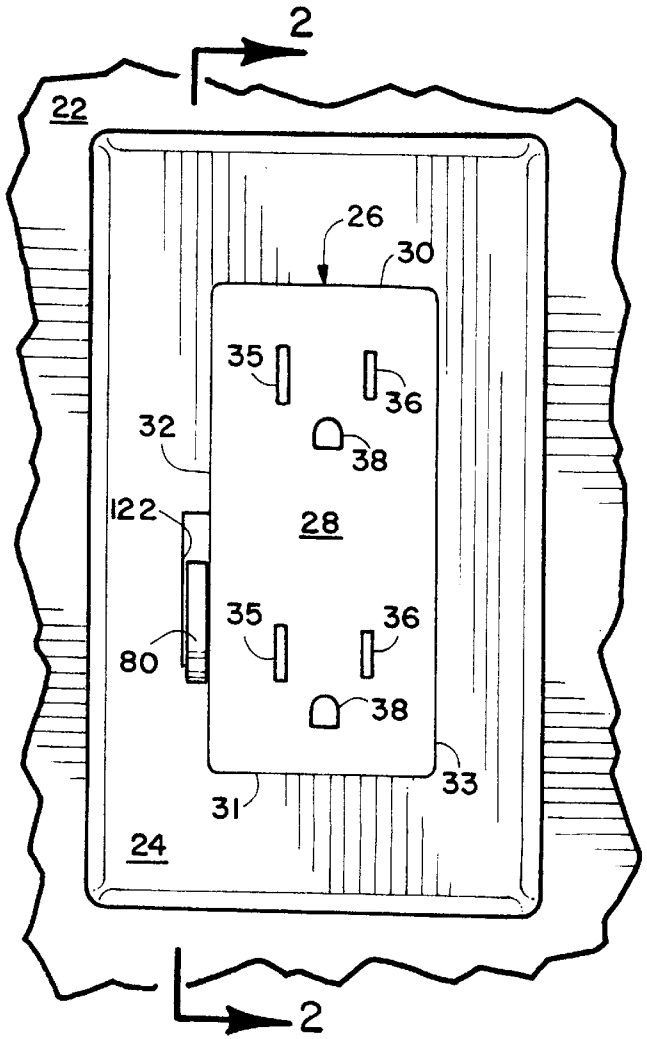
FIG. 1 is a front elevation view of the novel lockable wall outlet electrical receptacle.

The novel lockable wall outlet electrical receptacle will now be described by referring to the FIGS. 1–11 of the drawings. The lockable wall outlet electrical receptacle is generally designated numeral 20. In FIG. 1 it is shown mounted in an aperture 21 in wall or panel 22 and it is surrounded by a cover plate 24.

Lockable wall outlet electrical receptacle 20 has a housing 26 having a front wall surface 28, a rear wall surface 29, a top wall surface 30, a bottom wall surface 31, a left side wall surface 32 and a right wall surface 33. Two sets of electrical plug apertures 35 and 36 and ground prong aperture 38 are formed in front wall surface 28. Housing 26 is made of a plastic material that electrically non-conductive.

Figures 5, 6, 7, 8, 9, 10, 11:
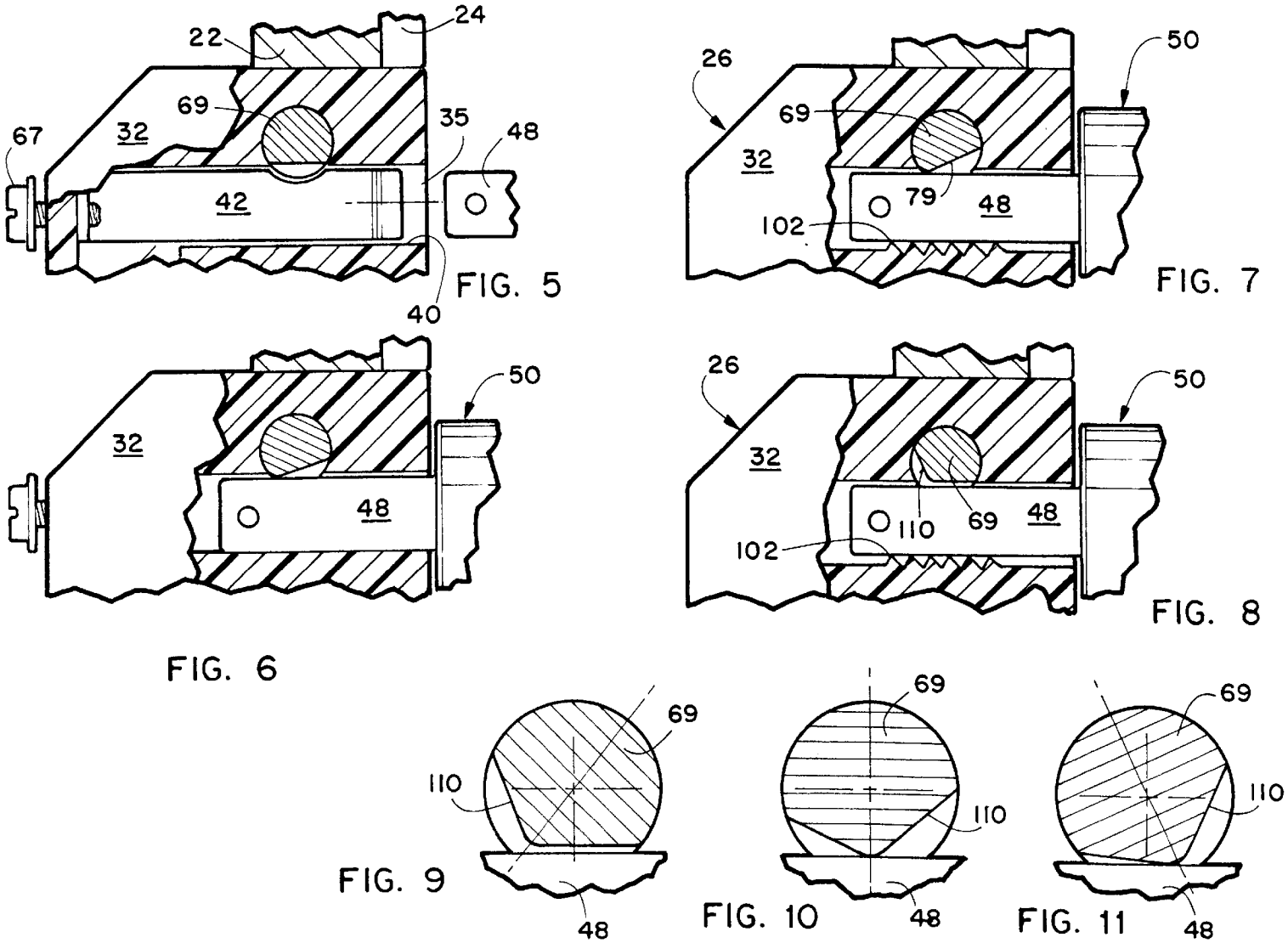
FIG. 5 is a partial side elevation view of the housing with portions broken away and in cross section showing it prior to inserting the blade prong of a male electrical connector.
FIG. 6 is a partial side elevation view of the housing with portions broken away and in cross section after inserting the blade prong of a male electrical connector and locking it therein.
FIG. 7 is a view similar to that illustrated in FIG. 6 showing the use of ridges or teeth extending upwardly from the top surface of the channel that contact the blades of the male electrical plug.
FIG. 8 is a view similar to FIG. 7 wherein the recess in the periphery of the shaft has a first alternative cross section.
FIG. 9 is a partial cross sectional view showing the orientation of the shaft as illustrated in FIG. 8.
FIG. 10 is a partial cross sectional view showing the apex of the cam surface on the shaft in FIG. 9 rotated into a contact position with the top surface of the male blade of an electrical plug.
FIG. 11 shows the next stage following FIG. 10 wherein the shaft is rotated past the over-center position of the cam surface to lock the male electrical plug into the wall outlet electrical receptacle.

Each of the respective apertures in front wall surface 28 have aligned channels 40 extending inwardly into the interior of housing 26. One of these channels 40 is illustrated in FIG. 5 behind electrical plug aperture 35. A channel 40 behind electrical plug aperture 36 would be substantially identical. Likewise the channel 40 behind the ground prong aperture will have a configuration to receive a ground prong socket (not shown).

Figure 3:
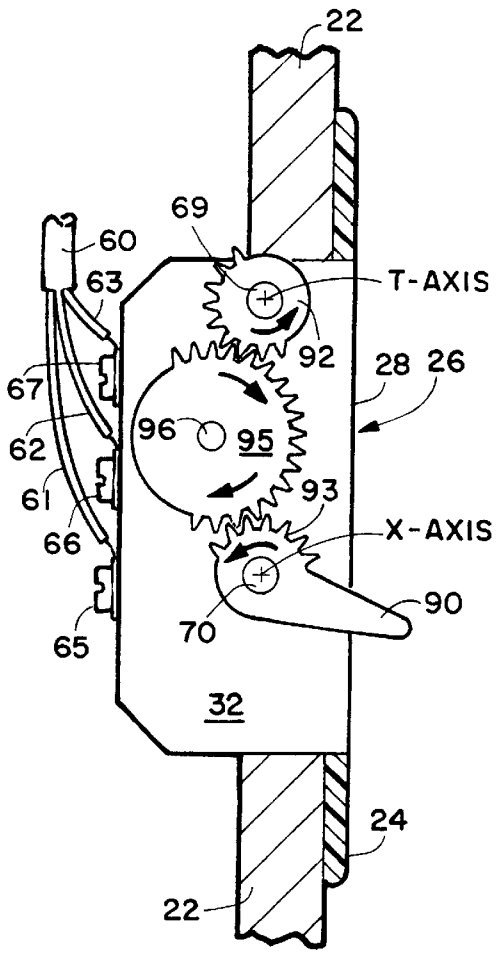
FIG. 3 is a vertical cross section of a first alternative shaft rotating structure that could be used instead of the structure illustrated in FIG. 2.

Left blade prong terminal 42 could be in the form of a single length of electrically conductive material or it could have a Y-configuration that would contact blade prong 48 of the male electrical plug 50. The two respective structures are well known in the prior art. The blade prong terminals 42 and the ground socket (not shown) would be connected to electrical wire connection terminals on the outside surface of the housing 26. FIG. 3 shows an electrical cord having a hot wire 61, a neutral wire 62 and ground wire 63. Hot wire 61 is connected to electrical wire connection terminal 65. Neutral electrical wire 62 is connected to electrical wire connection terminal 66 and ground wire 63 is connected to electrical wire connection terminal 67. The structure connecting the respective electrical wire connection terminals to the respective blade prong terminals and ground socket are not discussed because their structure is well known in the prior art and readily understood by persons having ordinary skill in the art.

Figure 4:
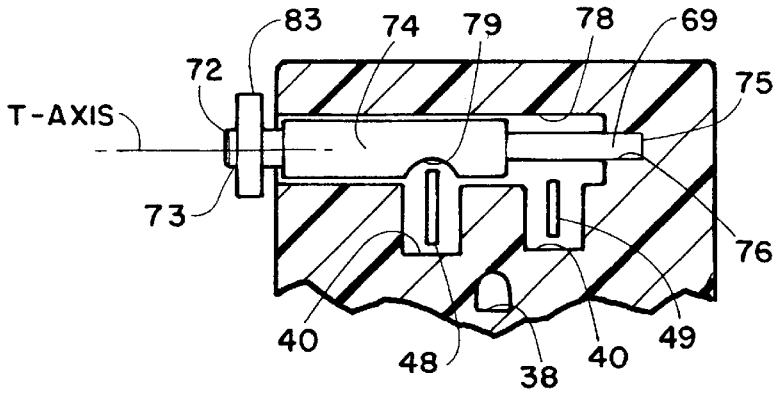
FIG. 4 is a partial vertical cross section view through a portion of the wall outlet electrical receptacle housing illustrating how one of the shafts is mounted therein.

Upper shaft 69 and lower shaft 70 extend outwardly from left side wall surface 32. Only the structure of shaft 69 is illustrated in FIG. 4 and it is to be clearly understood that shaft 70 would have the same structure and operate in the same manner. Referring to FIG. 4, shaft 69 has a front end 72 that is captured in a bore hole 73 in lever arm 83. It has a rear end 75 that is journaled in a recess 76 formed in housing 26. Shaft 69 passes through a bore hole 78 also formed in housing 26. Shaft 69 has a longitudinally extending T-axis and it is located a predetermined height above the bottom surface of the respective channels 40 and the respective blade prong terminals positioned therein. The blade prong terminals 42 are not illustrated in FIG. 4 so that the manner in which the blade prong 48 of male electrical plug 50 functions with respect to annular shoulder 74 formed on shaft 69. Groove 79 aligns with blade prong 48 as it is inserted into its respective channel 40. The other blade prong 49 of male electrical plug 50 does not come in contact with shaft 69 nor annular shoulder 73 during its insertion nor when the locking action takes place. A more explicit description of a similar structure is set forth in U.S. patent application No. 09/816,702 filed on Mar. 26, 2001 and this is incorporated by references.

FIG. 5 shows the orientation of shaft 69 when blade prong 48 is either inserted or removed. In FIG. 6, shaft 69 has been rotated in a manner to be described later so that it locks blade prong 48 within channel 40.

Figure 2:
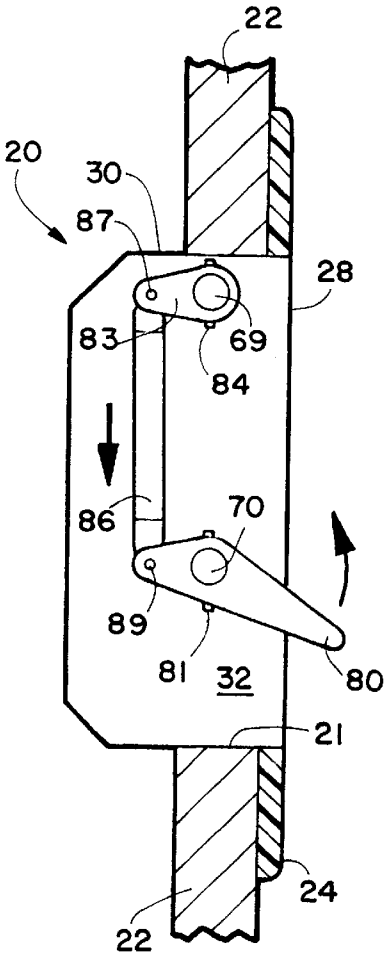
FIG. 2 is a cross sectional view taken along lines 2—2 of FIG. 1.

In FIG. 2, a lever arm 80 is shown attached to lower shaft 70 by a pin 81. A lever arm 83 is shown attached to the front end of upper shaft 69 by a pin 84. A link arm 86 has its top end pivotally attached to lever arm 83 by a pin 87 and its bottom end pivotally attached to lever arm 80 by a pin 89. An upward lifting on the front end of lever 80 will cause both shafts 69 and 70 to rotate from an unlocked position to the locked position as illustrated in FIG. 6.

An alternative mechanism for actuating the locking and unlocking mechanism of lockable wall outlet electrical receptacle 20 is illustrated in FIG. 3. Lever arm 90 has its rear end rigidly secured to the front end of shaft 70 and a gear 92 is rigidly secured to the front end of shaft 69. The gear portion 93 of lever arm 90 meshes with an idler gear 95 mounted on a shaft 96. Idler gear also meshes with gear 92 so that an upward motion on the front end of lever arm 90 will rotate the respective shafts 69 and 70 from an unlocked position to the locked position illustrated in FIG. 6. FIG. 7 shows a view similar to that of FIG. 6 but with channel 40 having a bunch of upwardly protruding teeth 102 that help frictionally engage the bottom edge surface of blade prong 48.

FIG. 8 shows the recess in shaft 69 having a cam surface 110 located at a position above blade prong 48. In FIG. 9 blade prong 48 is free to be inserted or removed from housing 26. In FIG. 10 shaft 69 has been rotated sufficiently that the apex of cam 110 is pressed against the top edge of blade prong 48. In FIG. 11, the rotation of shaft 69 has taken it overcenter and locks blade prong 48 against removal from housing 26.

Figure 12:
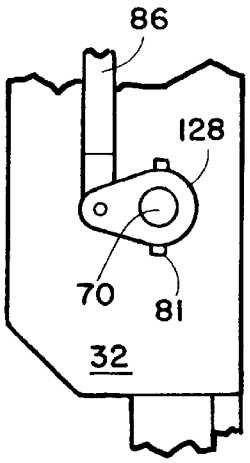
FIGS. 12 and 13 show how the embodiments in FIGS. 2 and 3 could be modified to be actuated by a knob.
Figure 13:
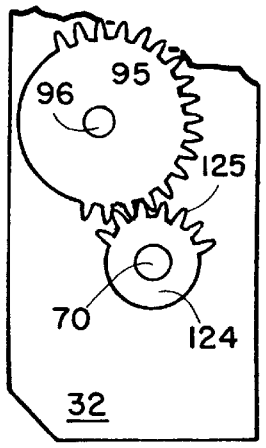
Figure 15:
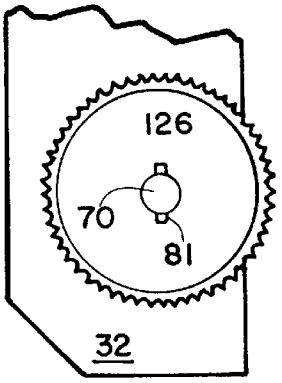
FIGS. 14 and 15 are a partial front elevation view of the embodiments shown in FIGS. 12 and 13 showing how they would look with a knob on their lower shaft.
Figure 14:
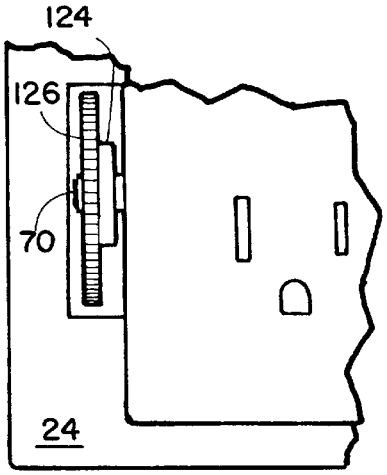

The embodiment illustrated in FIGS. 2 and 3 can be modified so that either one could be operated by a knob 126 having a knurled periphery mounted on the front end of shaft 70 that would extend outwardly through cutout 122 in front panel 24. FIG. 12 shows that the structure of lever arm 80 shown in FIG. 2 can be changed to the structure of lever arm 128. FIG. 13 shows that the structure of lever arm 90 shown in FIG. 3 can be changed to the structure of gear 124 having a gear portion 125. FIGS. 14 and 15 show that the two new embodiments would have a knob 126 having a knurled periphery mounted on shaft 70. Rotation upwardly of knob 126 will lock blade prong 48 in lockable wall outlet electrical receptacle 20.

What is claimed is:

1. A lockable wall outlet electrical outlet comprising:

a housing having a front wall surface, a rear wall surface, a top wall surface, a bottom wall surface, a left side wall surface and a right side wall surface; at least a first pair of laterally spaced electrical plug apertures are formed in said front wall surface;

each of said pairs of electrical plug apertures having a metallic right blade prong terminal positioned behind said front wall surface in said housing; said metallic left blade prong terminals being electrically connected to their own electrical wire connection terminal; first means for holding said left blade prong terminals in a substantially fixed position;

each of said pairs of electrical plug apertures having a metallic white blade terminal positioned behind said front wall surface in said housing; said metallic right blade terminals being electrically connected to their own electrical wire connection terminal; second means for holding said right blade prong terminals in a substantially fixed position;

a horizontally oriented elongated first shaft having a front end, a rear end, and a longitudinally extending X-axis; said front end of said shaft extends outwardly through a bore hole in one of said side wall surfaces of said housing and said rear end being rotatably supported by structure in said housing; said X-axis being vertically positioned a predetermined distance above the mid-point height of said electrical plug apertures in said front wall surface of said housing;

said first shaft having first locking means for gripping at least one of the male blade prongs of a male electrical plug that may be inserted into said first pair of electrical plug apertures formed in said front wall surface of said housing; and first gripping means on said front end of said first shaft for aiding in rotating said first shaft between a locked position and an unlocked position.

2. A lockable wall outlet electrical receptacle as recited in claim 1 further comprising a ground prong aperture in said front wall surface of said housing below each pair of laterally spaced electrical plug apertures.

3. A lockable wall outlet electrical receptacle as recited in claim 1 further comprising means for limiting the degrees of rotation of said first shaft.

4. A lockable wall outlet electrical receptacle as recited in claim 1 wherein said housing has a second pair of laterally spaced electrical plug apertures formed in said front wall surface and said second pair of laterally spaced electrical plug apertures is vertically spaced from said first pair of laterally spaced electrical plug apertures.

5. A lockable wall outlet electrical receptacle as recited in claim 4 further comprising a horizontally oriented elongated second shaft having a front end, a rear end and a longitudinally extending T-axis; said front end of said second shaft extends outwardly through a bore hole in one of said side wall surfaces of said housing and said rear end of said second shaft being rotatably supported by structure in said housing; said T-axis being vertically positioned a predetermined distance above said mid-point height of said second pair of laterally spaced electrical plug apertures in said front wall surface of said housing.

6. A lockable wall outlet electrical receptacle as recited in claim 5 wherein said second shaft has second locking means for gripping at least one of the male blade prongs of a male electrical plug that may be inserted into said second pair of laterally spaced electrical plug apertures formed in said front wall surface of said housing.

7. A lockable wall outlet electrical receptacle as recited in claim 6 further comprising second gripping means on said front end of said second shaft for aiding in rotating said second shaft between a locked position and an unlocked position.

8. A lockable wall outlet electrical receptacle as recited in claim 7 further comprising mechanical means connecting said first gripping means to said second gripping means so that they are activated at the same time.

9. A lockable wall outlet electrical receptacle as recited in claim 8 wherein said mechanical means is a link arm.

10. A lockable wall outlet electrical receptacle as recited in claim 8 wherein said mechanical means is an idler gear.

11. A lockable wall outlet electrical receptacle as recited in claim 6 wherein said second locking means comprises an annular shoulder on said second shaft and said annular shoulder has a transversely extending groove in its periphery.

12. A lockable wall outlet electrical receptacle as recited in claim 1 wherein said first locking means comprises an annular shoulder on said first shaft and said annular shoulder has a transversely extending groove on its periphery.

13. A lockable wall outlet electrical receptacle as recited in claim 1 wherein said first gripping means on said front end of said first shaft is a lever arm.

14. A lockable wall outlet electrical receptacle as recited in claim 1 further comprising means on said housing for connecting the hot wire, the neutral wire and ground wire of the electrical cord.

15. A lockable wall outlet electrical receptacle as recited in claim 1 wherein said first gripping means of said front end of said first shaft is a finger gripping knob.

* * * * *